US008672307B1

(12) United States Patent
Pacheco et al.

(10) Patent No.: US 8,672,307 B1
(45) Date of Patent: Mar. 18, 2014

(54) STRETCH LINER CLAMP

(76) Inventors: Martin I. Pacheco, Chula Vista, CA (US); Cesar Cruz, Chula Vista, CA (US)

( * ) Notice: Subject to any disclaimer, the term of this patent is extended or adjusted under 35 U.S.C. 154(b) by 612 days.

(21) Appl. No.: 12/927,230

(22) Filed: Nov. 10, 2010

Related U.S. Application Data

(60) Provisional application No. 61/337,473, filed on Feb. 4, 2010.

(51) Int. Cl.
*B25B 5/00* (2006.01)

(52) U.S. Cl.
USPC ..... 269/6; 269/3; 269/95; 29/268

(58) Field of Classification Search
USPC ..... 269/6, 3, 95, 149, 249; 29/257, 276, 29/268, 267
See application file for complete search history.

(56) References Cited

U.S. PATENT DOCUMENTS 4,020,530 A 5/1977 Sartore
4,813,107 A 3/1989 Cetrone
5,074,175 A * 12/1991 Earle ..... 81/302
5,460,461 A * 10/1995 McGrath ..... 404/118
5,765,820 A * 6/1998 Marusiak ..... 269/6
6,000,686 A * 12/1999 Yates ..... 269/6
6,012,361 A * 1/2000 Wooster et al. ..... 81/367
7,950,122 B2 * 5/2011 Saylor ..... 29/268

* cited by examiner

*Primary Examiner* — Lee D Wilson
(74) *Attorney, Agent, or Firm* — Emery L. Tracy; Ruth Eure

(57) ABSTRACT

A clamp mechanism for assisting a bricklayer or mason worker in positioning and aligning a next row of bricks being laid upon a previous row of bricks using an alignment string is provided. One end of the alignment string is secured in a desired position adjacent the previous row of bricks. The clamp mechanism comprises a clamp having a first clamp arm and a second clamp arm. A spring mechanism biases the first clamp arm and the second clamp arm in a general direction toward each other. A string receiving mechanism is associated with the clamp for receiving a portion of the alignment string. Upon the alignment string being secured to the string receiving mechanism and the clamp being positioned upon a brick in the previous row of bricks, the alignment string indicates the proper positioning and alignment of the next row of bricks.

4 Claims, 1 Drawing Sheet

STRETCH LINER CLAMP

The present application claims the benefit of priority of pending provisional patent application Ser. No. 61/337,473, filed on Feb. 4, 2010, entitled "Stretch liner clamp".

BACKGROUND OF THE INVENTION

1. Field of the Invention

This invention relates generally to a stretch liner clamp and, more particularly, the invention relates to a stretch liner clamp for facilitating attachment of the alignment string and positioning the string in the exact alignment desired by the bricklayer for the row of bricks being laid.

2. Description of the Prior Art

When building a structure, brick masons use one of two methods, either the corner lead or the corner pole. Using the corner lead method, they begin by constructing a pyramid of bricks at each corner called a lead. After the corner leads are complete, less experienced brick masons fill in the wall between the corners using a line from corner to corner to guide each course, or layer, of brick. Due to the precision needed, corner leads are time-consuming to erect and require the skills of experienced bricklayers. Because of the expense associated with building corner leads, some brick masons use corner poles, also called masonry guides enabling them to build an entire wall at the same time. They fasten the corner poles (posts) in a plumb position to define the wall line and stretch an alignment line between them. The alignment string serves as a guide for indicating the edge of the row and for positioning the bricks.

Unfortunately, the alignment line can lose its place either because the alignment line is not taut or from being bumped accidentally. It would be beneficial to provide a quick and reliable means of establishing that reference point and ensuring that the alignment string is, in fact, always in proper alignment.

SUMMARY

The present invention is a clamp mechanism for assisting a bricklayer or mason worker in positioning and aligning a next row of bricks being laid upon a previous row of bricks using an alignment string. One end of the alignment string is secured in a desired position adjacent the previous row of bricks. The clamp mechanism comprises a clamp having a first clamp arm and a second clamp arm. A spring mechanism biases the first clamp arm and the second clamp arm in a general direction toward each other. A string receiving mechanism is associated with the clamp for receiving a portion of the alignment string. Upon the alignment string being secured to the string receiving mechanism and the clamp being positioned upon a brick in the previous row of bricks, the alignment string indicates the proper positioning and alignment of the next row of bricks.

In addition, the present invention includes a method for assisting a bricklayer or mason worker in positioning and aligning a next row of bricks being laid upon a previous row of bricks using an alignment string. One end of the alignment string is secured in a desired position adjacent the previous row of bricks. The method comprises providing a clamp having a first clamp arm and a second clamp arm, biasing the first clamp arm and the second clamp arm in a general direction toward each other, associating a string receiving mechanism with the clamp, positioning a portion of the alignment string within the string receiving mechanism, positioning the clamp upon a brick in the previous row of bricks, and laying the next row of bricks along the alignment string.

The present invention further includes a clamp system for assisting a bricklayer or mason worker in positioning and aligning a next row of bricks being laid upon a previous row of bricks using an alignment string. The clamp system comprises a first clamp having a first clamp arm and a second clamp arm. A first spring mechanism biases the first clamp arm and the second clamp arm of the first clamp in a general direction toward each other. A first string receiving mechanism is associated with the first clamp for receiving a portion of the alignment string. A second clamp is provided having a first clamp arm and a second clamp arm. A second spring mechanism biases the first clamp arm and the second clamp arm of the second clamp in a general direction toward each other. A second string receiving mechanism is associated with the second clamp for receiving a portion of the alignment string. Upon the first clamp being positioned upon a brick in the previous row of bricks and the second clamp being positioned upon another brick in the previous row of bricks, the alignment string is securable between the first string receiving mechanism and the second string receiving mechanism indicating the proper positioning and alignment of the next row of bricks.

DETAILED DESCRIPTION OF THE PREFERRED EMBODIMENTS

Figure 2:
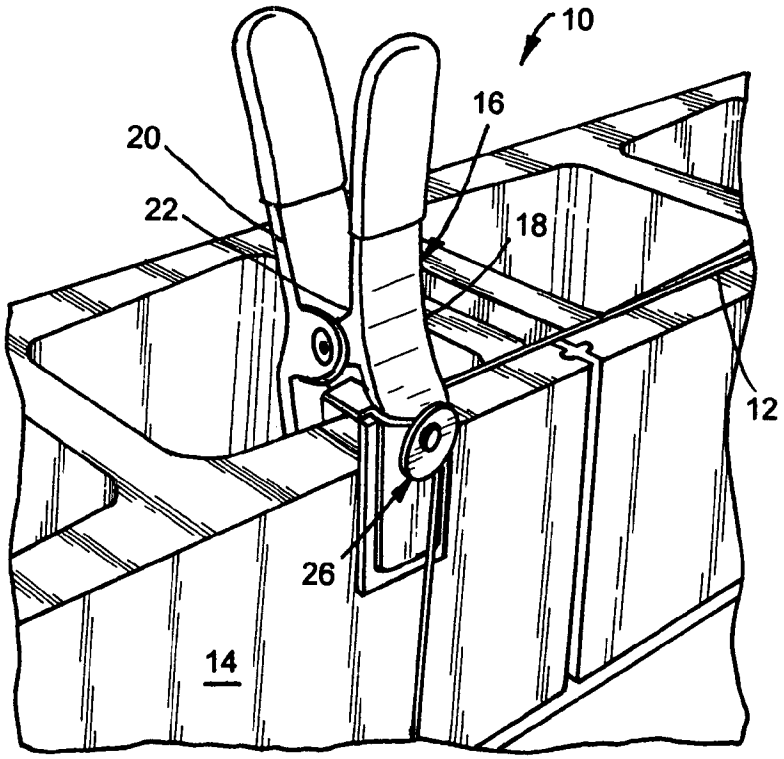
FIG. 2 is a perspective view illustrating the stretch liner clamp, constructed in accordance with the present invention, with an alignment string releasably secured thereto.
Figure 1:
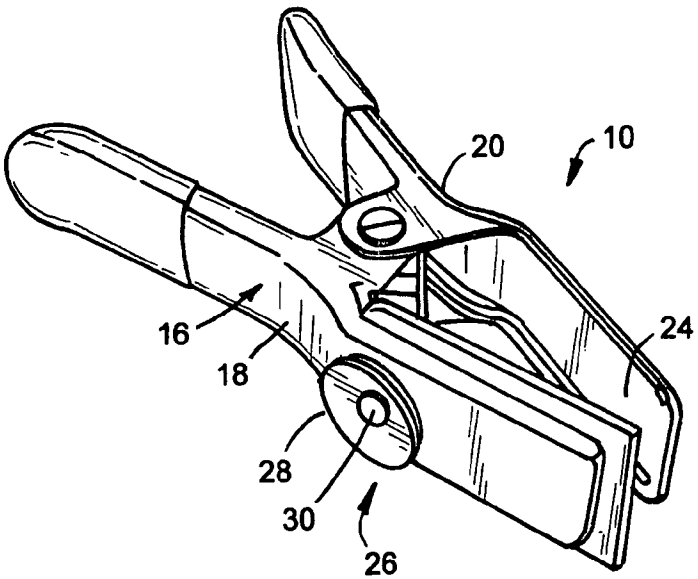
FIG. 1 is a perspective view illustrating a stretch liner clamp, constructed in accordance with the present invention.

As illustrated in FIGS. 1 and 2, the present invention is a stretch liner clamp, indicated generally at 10, for facilitating attachment of an alignment string 12 and positioning the alignment string 12 in the exact alignment desired by the bricklayer or mason for the row of bricks 14 being laid. The stretch liner clamp 10 of the present invention assists bricklayers and masons in laying bricks 14 in a precise and accurate manner.

The stretch liner clamp 10 of the present invention comprises a clamp 16 having a first clamp arm 18 and a second clamp arm 20. A spring mechanism 22 biases the first clamp arm 18 and the second clamp arm 20 together and each clamp arm 18, 20 can preferably have a hard rubber pad 24 at the clamping end to protect the item to which the clamp 16 is applied. Preferably, the clamp 16 is an A-type spring clamp, approximately seven (7") inches in height and approximately five (5") inches in width although utilizing other types of clamps having different dimensions is within the scope of the present invention. Also, it is preferable that the clamp 16 is used and sold in pairs in order to stretch the alignment string 12 therebetween, as will be described in further detail below.

The stretch liner clamp 10 of the present invention further includes a string receiving mechanism 26 for receiving the alignment string 12 and releasably, yet securely, holding the alignment string 12. The string receiving mechanism 26 can be a knob extending from one or both of the clamp arms, a serrated notch formed in the clamp, or precisely situated spring-biased clip attached to the clamp 16 all for facilitating attachment of the alignment string 12 and positioning the alignment string 12 in the exact alignment desired by the bricklayer for the row of bricks 14 being laid.

In a preferred embodiment, the string receiving mechanism 26 of the stretch liner clamp 10 of the present invention is a circular disk or plate 28 supported on a post 30 to extending from one of the clamp arms 18, 20 of the clamp 16. The alignment string 12 is wrapped around the post 30 with the disk 28 maintaining the alignment string 12 between the clamp arm 18, 20 and the disk 28. A circular disk 28 is preferred to inhibit the alignment string 12 from being caught on a corner, as might occur with a different shape. It should be noted, however, that while the disk 28 has been described and illustrated as being circular, it is within the scope of the present invention for the disk 28 to have other geometric shapes.

The stretch liner clamp 10 of the present invention can be constructed from a steel or aluminum material although constructing the stretch liner clamp 10 from other materials is within the scope of the present invention. Simply by clamping one stretch liner clamp 10 to a brick 14 at one end of the previous row (the row about to be built upon), and the second stretch liner clamp 10 to a brick 14 at the far end of the previous row, then fastening the alignment string 12 to each notch or knob 26 on the stretch liner clamps 10, the precise line of the next row of bricks 14 is indicated quickly, easily, and accurately. It should be noted that in order to insure best alignment, the alignment string 12, after being secured to the string receiving mechanism 26, can be positioned between the clamping arms 18, 20 thereby aligning the alignment string 12 directly over the previous row of bricks 14.

With the stretch liner clamp 10 of the present invention, the bricklayer or mason has an accurate, reliable tool for establishing the proper line, the proper course for a row of bricks 14, every time. Once the alignment line is established with the stretch liner clamp 10, the stretch liner clamp 10 secures the alignment line in place with the clamp arms 18, 20 and hard rubber pads 24 keeping the line steadfast ensuring accurate wall line while laying brick 14. The stretch liner clamp 10 effectively saves bricklayers and mason workers money, time, and effort. Mistakes can be expensive and take valuable time to fix. The gripping action of the stretch liner clamp 10 ensures a snug fit thus providing an accurate brick line each time, every time.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A clamp system for assisting a bricklayer or mason worker in positioning and aligning a next row of bricks being laid upon a previous row of bricks using an alignment string, the clamp system comprising:

a first clamp having a first clamp arm and a second clamp arm;

a first spring mechanism biasing the first clamp arm and the second clamp arm of the first clamp in a general direction toward each other;

a first string receiving mechanism associated with the first clamp for receiving a portion of the alignment string;

a second clamp having a first clamp arm and a second clamp arm;

a second spring mechanism biasing the first clamp arm and the second clamp arm of the second clamp in a general direction toward each other; and a second string receiving mechanism associated with the second clamp for receiving a portion of the alignment string;

wherein the first and second string receiving mechanisms are a disk supported on a post extending from at least one of the clamp arms of the clamps; and wherein upon the first clamp being positioned upon a brick in the previous row of bricks and the second clamp being positioned upon another brick in the previous row of bricks, the alignment string is securable between the first string receiving mechanism and the second string receiving mechanism indicating the proper positioning and alignment of the next row of bricks.

2. The clamp system of claim 1 and further comprising:

a hard rubber pad at a clamping end of each of the first clamp arms and the second clamp arms.

3. The clamp system of claim 1 wherein the alignment string, after being secured between the string receiving mechanisms, is positioned between the clamp arms of each clamp thereby aligning the alignment string directly over the previous row of bricks.

4. The clamp mechanism of claim 1 wherein each clamp is an A-type spring clamp.

* * * * *